US009146511B2

(12) United States Patent
Qi et al.

(10) Patent No.: US 9,146,511 B2
(45) Date of Patent: Sep. 29, 2015

(54) FUSER MEMBER

(71) Applicant: Xerox Corporation, Norwalk, CT (US)

(72) Inventors: Yu Qi, Oakville (CA); Brynn M. Dooley, Toronto (CA); Nan-Xing Hu, Oakville (CA)

(73) Assignee: Xerox Corporation, Norwalk, CT (US)

( * ) Notice: Subject to any disclaimer, the term of this patent is extended or adjusted under 35 U.S.C. 154(b) by 251 days.

(21) Appl. No.: 13/870,440

(22) Filed: Apr. 25, 2013

(65) Prior Publication Data

US 2014/0321894 A1 Oct. 30, 2014

(51) Int. Cl.
*G03G 15/20* (2006.01)

(52) U.S. Cl.
CPC ..... *G03G 15/206* (2013.01); *G03G 2215/2048* (2013.01)

(58) Field of Classification Search
CPC ..... G03G 15/206; G03G 15/2053; G03G 2215/2048; G03G 2215/2051; G03G 15/2057; B41N 7/005; B41N 7/06
USPC ..... 399/320, 324, 325, 330, 331, 333; 219/216; 492/18, 53, 56, 59; 430/124.32, 124.33, 124.35
See application file for complete search history.

(56) References Cited

U.S. PATENT DOCUMENTS

| | | | | |
|---|---|---|---|---|
| 4,593,480 | A * | 6/1986 | Mair et al. | 34/78 |
| 4,791,275 | A * | 12/1988 | Lee et al. | 219/469 |
| 5,232,499 | A * | 8/1993 | Kato et al. | 118/244 |
| 5,776,043 | A * | 7/1998 | Kato et al. | 492/56 |
| 5,864,740 | A * | 1/1999 | Heeks et al. | 399/325 |
| 7,491,435 | B2 | 2/2009 | Gervasi et al. | |
| 8,135,324 | B2 * | 3/2012 | Moorlag | 399/333 |
| 8,509,669 | B2 * | 8/2013 | Moorlag et al. | 399/333 |
| 8,615,188 | B2 * | 12/2013 | Moorlag et al. | 399/333 |
| 8,929,792 | B2 * | 1/2015 | Qi et al. | 399/333 |
| 2010/0155644 | A1 * | 6/2010 | Ou et al. | 252/62 |
| 2014/0178579 | A1 * | 6/2014 | Qi et al. | 427/202 |

FOREIGN PATENT DOCUMENTS

JP 2011042723 A * 3/2011

* cited by examiner

*Primary Examiner* — Robert Beatty
(74) *Attorney, Agent, or Firm* — Hoffman Warnick LLC

(57) ABSTRACT

A fuser member having a substrate and a surface layer disposed on the substrate is described. The surface layer includes a polyimide aerogel having dispersed throughout a cross-linked fluoropolymer and a release agent wherein the release agent is a liquid at a temperature above about 100° C.

19 Claims, 4 Drawing Sheets

FUSER MEMBER

BACKGROUND

Field of Use

This disclosure is generally directed to surface layers for fuser members useful in electrophotographic imaging apparatuses, including digital, image on image, and the like.

Background

In the electrophotographic printing process, a toner image can be fixed or fused upon a support (e.g., a paper sheet) using a fuser roller. Conventional fusing technologies apply release agents/fuser oils to the fuser roller during the fusing operation, in order to maintain good release properties of the fuser roller. For example, oil fusing technologies have been used for all high speed products in the entry production and production color market. Other fuser technologies use compositions that have a low surface energy but are not conformable.

A coating having a low surface energy that is conformable, durable and easily manufactured is desirable.

SUMMARY

According to an embodiment, there is provided a fuser member including a substrate and a surface layer disposed on the substrate. The surface layer includes a polyimide aerogel having dispersed throughout a cross-linked fluoropolymer and a release agent wherein the release agent is a liquid at a temperature above about 100° C.

According to another embodiment, there is provided a fuser member having a substrate, an intermediate layer disposed on the substrate and a surface layer disposed on the intermediate layer. The surface layer includes a polyimide aerogel having dispersed throughout a cross-linked fluoropolymer and a release agent. The cross-linked fluoropolymer is from about 10 weight percent to about 95 weight percent of the surface layer. The release agent is a liquid at a temperature at 100° C. or greater. The release agent comprises from about 1 weight percent to about 50 weight percent of the surface layer.

According to another embodiment, there is described a fuser member having a substrate and a surface layer disposed on the substrate. The surface layer includes a polyimide aerogel having dispersed throughout a siloxyfluorocarbon (SFC) networked polymer and a fluorinated polyhedral oligomeric silsesquioxane release agent. The polyimide aerogel has a porosity of from about 50 percent to about 95 percent. The polyimide aerogel layer has pores having a pore diameter of from about 2 nanometers to about 200 nanometers. The polyimide aerogel layer has a thickness of from about 5 microns to about 400 microns.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

Figure 1:
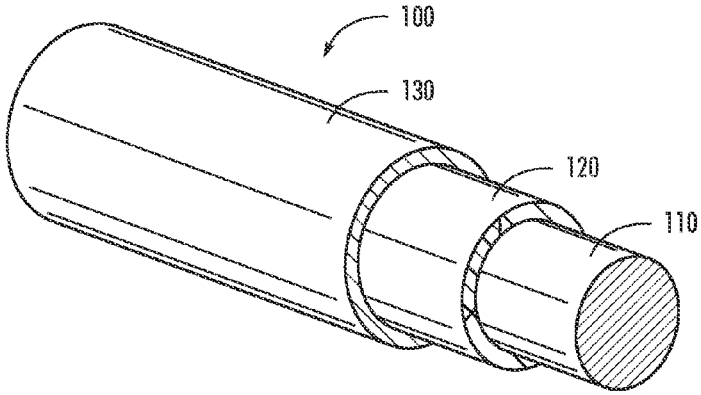
FIG. 1 depicts an exemplary fusing member having a cylindrical substrate in accordance with the present teachings.

It should be noted that some details of the FIGS. have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts.

In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Illustrations with respect to one or more implementations, alterations and/or modifications can be made to the illustrated examples without departing from the spirit and scope of the appended claims. In addition, while a particular feature may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." The term "at least one of" is used to mean one or more of the listed items can be selected.

Notwithstanding that the numerical ranges and parameters setting forth the broad scope of embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

In various embodiments, the fixing member can include, for example, a substrate, with one or more functional layers formed thereon. The substrate can be formed in various shapes, e.g., a cylinder (e.g., a cylinder tube), a cylindrical drum, a belt, or a film, using suitable materials that are non-conductive or conductive depending on a specific configuration, for example, as shown in FIGS. 1 and 2.

Figure 2:
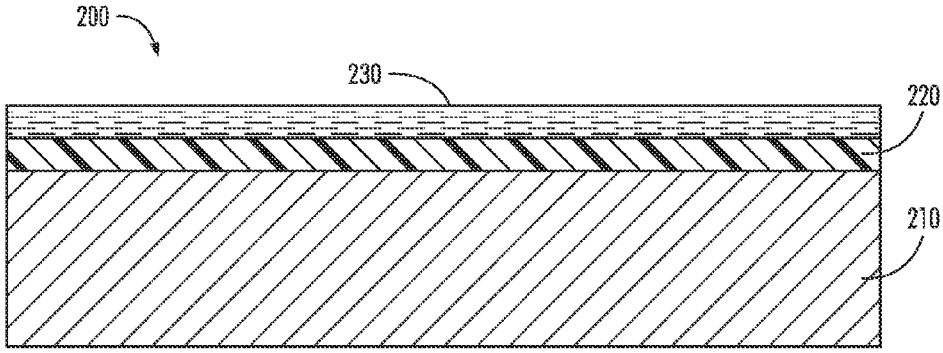
FIG. 2 depicts an exemplary fusing member having a belt substrate in accordance with the present teachings.

Specifically, FIG. 1 depicts an exemplary fixing or fusing member 100 having a cylindrical substrate 110 and FIG. 2 depicts another exemplary fixing or fusing member 200 having a belt substrate 210 in accordance with the present teachings. It should be readily apparent to one of ordinary skill in the art that the fixing or fusing member 100 depicted in FIG. 1 and the fixing or fusing member 200 depicted in FIG. 2 represent generalized schematic illustrations and that other layers/substrates can be added or existing layers/substrates can be removed or modified.

In FIG. 1, the exemplary fixing member 100 can be a fuser roller having a cylindrical substrate 110 with one or more functional layers 120 (also referred to as intermediate layers) and an outer layer 130 formed thereon. In various embodiments, the cylindrical substrate 110 can take the form of a cylindrical tube, e.g., having a hollow structure including a heating lamp therein, or a solid cylindrical shaft. In FIG. 2, the exemplary fixing member 200 can include a belt substrate 210 with one or more functional layers, e.g., 220 and an outer surface 230 formed thereon.

Substrate Layer

The belt substrate 210 (FIG. 2) and the cylindrical substrate 110 (FIG. 1) can be formed from, for example, polymeric materials (e.g., polyimide, polyaramide, polyether ether ketone, polyetherimide, polyphthalamide, polyamide-imide, polyketone, polyphenylene sulfide, fluoropolyimides or fluoropolyurethanes) and metal materials (e.g., aluminum, nickel or stainless steel) to maintain rigidity and structural integrity as known to one of ordinary skill in the art.

Intermediate Layer

Examples of intermediate or functional layers 120 (FIG. 1) and 220 (FIG. 2) include fluorosilicones, silicone rubbers such as room temperature vulcanization (RTV) silicone rubbers, high temperature vulcanization (HTV) silicone rubbers, and low temperature vulcanization (LTV) silicone rubbers. These rubbers are known and readily available commercially, such as SILASTIC® 735 black RTV and SILASTIC® 732 RTV, both from Dow Corning; 106 RTV Silicone Rubber and 90 RTV Silicone Rubber, both from General Electric; and JCR6115CLEAR HTV and SE4705U HTV silicone rubbers from Dow Corning Toray Silicones. Other suitable silicone materials include the siloxanes (such as polydimethylsiloxanes); fluorosilicones such as Silicone Rubber 552, available from Sampson Coatings, Richmond, Va.; liquid silicone rubbers such as vinyl crosslinked heat curable rubbers or silanol room temperature crosslinked materials; and the like. Another specific example is Dow Corning Sylgard 182. Commercially available LSR rubbers include Dow Corning Q3-6395, Q3-6396, SILASTIC® 590 LSR, SILASTIC® 591 LSR, SILASTIC® 595 LSR, SILASTIC® 596 LSR, and SILASTIC® 598 LSR from Dow Corning. The functional layers provide elasticity and can be mixed with inorganic particles, for example SiC or $Al_2O_3$, as required.

Examples of intermediate or functional layers 120 (FIG. 1) and 220 (FIG. 2) also include fluoroelastomers. Fluoroelastomers are from the class of 1) copolymers of two of vinylidenefluoride, hexafluoropropylene, and tetrafluoroethylene; such as those known commercially as VITON A®, 2) terpolymers of vinylidenefluoride, hexafluoropropylene, and tetrafluoroethylene such as those known commercially as VITON B®; and 3) tetrapolymers of vinylidenefluoride, hexafluoropropylene, tetrafluoroethylene, and a cure site monomer, such as those known commercially as VITON GH® or VITON GF®. These fluoroelastomers are known commercially under various designations such as those listed above, along with VITON E®, VITON E 60C®, VITON E430®, VITON 910®, and VITON ETP®. The VITON® designation is a trademark of E.I. DuPont de Nemours, Inc. The cure site monomer can be 4-bromoperfluorobutene-1,1,1-dihydro-4-bromoperfluorobutene-1,3-bromoperfluoropropene-1,1,1-dihydro-3-bromoperfluoropropene-1, or any other suitable, known cure site monomer, such as those commercially available from DuPont. Other commercially available fluoropolymers include FLUOREL 2170®, FLUOREL 2174®, FLUOREL 2176®, FLUOREL 2177® and FLUOREL LVS 76®, FLUOREL® being a registered trademark of 3M Company. Additional commercially available materials include AFLAS™ a poly(propylene-tetrafluoroethylene), and FLUOREL II® (LII900) a poly(propylene-tetrafluoroethylenevinylidenefluoride), both also available from 3M Company, as well as the Tecnoflons identified as FOR-60KIR®, FOR-LHF®, NM® FOR-THF®, FOR-TFS® TH® NH®, P757® TNS®, T439 PL958® BR9151® and TN505®, available from Ausimont.

The fluoroelastomers VITON GH® and VITON GF® have relatively low amounts of vinylidenefluoride. The VITON GF® and VITON GH® have about 35 weight percent of vinylidenefluoride, about 34 weight percent of hexafluoropropylene, and about 29 weight percent of tetrafluoroethylene, with about 2 weight percent cure site monomer. Cure site monomers are available from Dupont.

For a roller configuration, the thickness of the intermediate or functional layer can be from about 0.5 mm to about 10 mm, or from about 1 mm to about 8 mm, or from about 2 mm to about 7 mm. For a belt configuration, the functional layer can be from about 25 microns up to about 2 mm, or from 40 microns to about 1.5 mm, or from 50 microns to about 1 mm.

Release Layer

An exemplary embodiment of a release layer 130 (FIG. 1), 230 (FIG. 2) includes a a surface layer including a polyimide aerogel having dispersed throughout a cross-linked fluoropolymer and a release agent wherein the release agent is a liquid at a temperature above about 100° C.

For the fuser member 100 (FIG. 1), 200 (FIG. 2), the surface layer or release layer 130 (FIG. 1), 230 (FIG. 2) can be from about 5 microns to about 400 microns, or from about 20 microns to about 300 microns, or from about 40 microns to about 250 microns in thickness.

Additives and additional conductive or non-conductive fillers may be present in the substrate layers 110 (FIG. 1) and 210 (FIG. 2), the intermediate layers 120 (FIG. 1) and 220 (FIG. 2) and the release layers 130 (FIG. 1) and 230 (FIG. 2). In various embodiments, other filler materials or additives including, for example, inorganic particles, can be used for the coating composition and the subsequently formed surface layer. Conductive fillers used herein may include carbon blacks such as carbon black, graphite, fullerene, acetylene black, fluorinated carbon black, and the like; carbon nanotubes; metal oxides and doped metal oxides, such as tin oxide, antimony dioxide, antimony-doped tin oxide, titanium dioxide, indium oxide, zinc oxide, indium oxide, indium-doped tin trioxide, and the like; and mixtures thereof. Certain polymers such as polyanilines, polythiophenes, polyacetylene, poly(p-phenylene vinylene), poly(p-phenylene sulfide), pyrroles, polyindole, polypyrene, polycarbazole, polyazulene, polyazepine, poly(fluorine), polynaphthalene, salts of organic sulfonic acid, esters of phosphoric acid, esters of fatty acids, ammonium or phosphonium salts and mixtures thereof can be used as conductive fillers. In various embodiments, other additives known to one of ordinary skill in the art can also be included to form the disclosed composite materials.

The release layer includes a polyimide aerogel having a fluoropolymer dispersed throughout the aerogel. Typical techniques for coating the fluoropolymer on the aerogel include flow coating, liquid spray coating, dip coating, wire wound rod coating, fluidized bed coating, powder coating, electrostatic spraying, sonic spraying, blade coating, molding, laminating, and the like.

Adhesive Layer

Optionally, any known and available suitable adhesive layer may be positioned between the release layer 130 (FIG. 1), 230 (FIG. 2), the intermediate layer 120 (FIG. 1), 220 (FIG. 2) and the substrate. 110 (FIG. 1), 210 (FIG. 2). Examples of suitable adhesives include silanes such as amino silanes (such as, for example, HV Primer 10 from Dow Corning), titanates, zirconates, aluminates, and the like, and mixtures thereof. In an embodiment, an adhesive in from about 0.001 percent to about 10 percent solution can be wiped on the substrate. The adhesive layer can be coated on the substrate, or on the outer layer, to a thickness of from about 2 nanometers to about 2,000 nanometers, or from about 2 nanometers to about 500 nanometers. The adhesive can be coated by any suitable known technique, including spray coating or wiping.

Figure 3A:
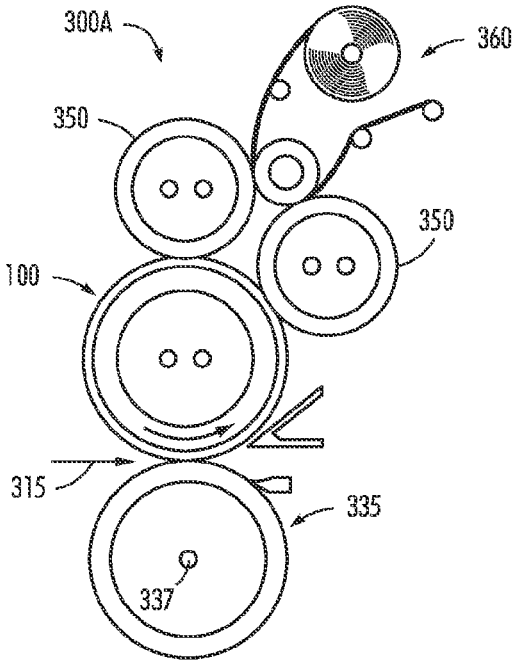
FIGS. 3A-3B depict exemplary fusing configuration using the fuser rollers shown in FIG. 1 in accordance with the present teachings.
Figure 3B:
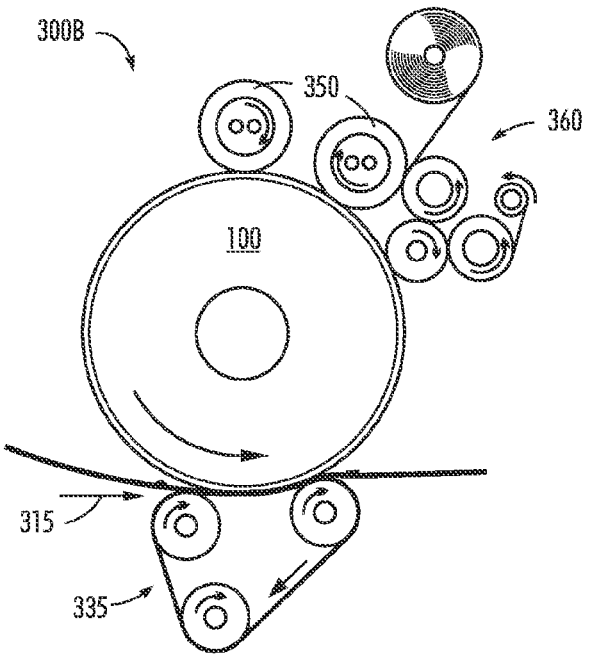
Figure 4A:
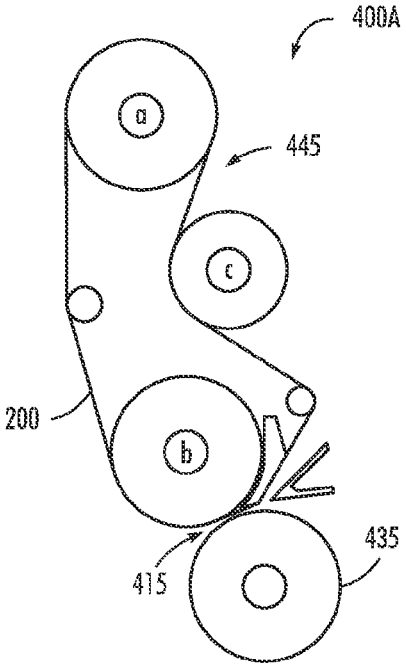
FIGS. 4A-4B depict another exemplary fusing configuration using the fuser belt shown in FIG. 2 in accordance with the present teachings.
Figure 4B:
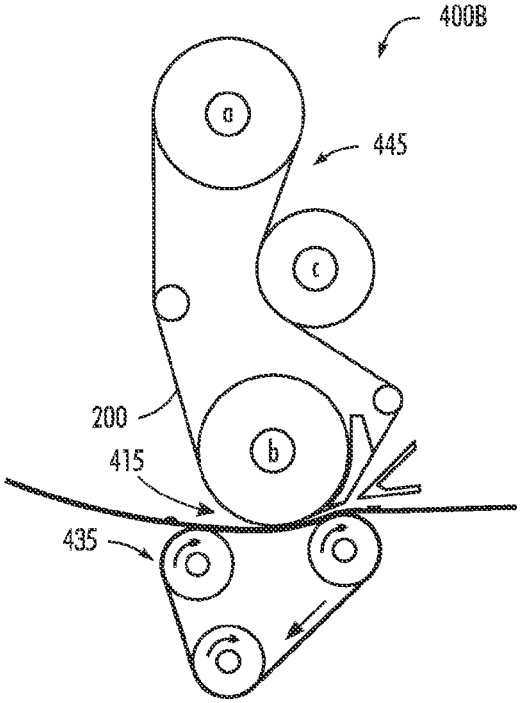

FIGS. 3A-3B and FIGS. 4A-4B depict exemplary fusing configurations for the fusing process in accordance with the present teachings. It should be readily apparent to one of ordinary skill in the art that the fusing configurations 300A-B depicted in FIGS. 3A-3B and the fusing configurations 400A-B depicted in FIGS. 4A-4B represent generalized schematic illustrations and that other members/layers/substrates/configurations can be added or existing members/layers/substrates/configurations can be removed or modified. Although an electrophotographic printer is described herein, the disclosed apparatus and method can be applied to other printing technologies. Examples include offset printing and inkjet and solid transfix machines.

FIGS. 3A-3B depict the fusing configurations 300A-B using a fuser roller shown in FIG. 1 in accordance with the present teachings. The configurations 300A-B can include a fuser roller 100 (i.e., 100 of FIG. 1) that forms a fuser nip with a pressure applying mechanism 335, such as a pressure roller in FIG. 3A or a pressure belt in FIG. 3B, for an image supporting material 315. In various embodiments, the pressure applying mechanism 335 can be used in combination with a heat lamp 337 to provide both the pressure and heat for the fusing process of the toner particles on the image supporting material 315. In addition, the configurations 300A-B can include one or more external heat roller 350 along with, e.g., a cleaning web 360, as shown in FIG. 3A and FIG. 3B.

FIGS. 4A-4B depict fusing configurations 400A-B using a fuser belt shown in FIG. 2 in accordance with the present teachings. The configurations 400A-B can include a fuser belt 200 (i.e., 200 of FIG. 2) that forms a fuser nip with a pressure applying mechanism 435, such as a pressure roller in FIG. 4A or a pressure belt in FIG. 4B, for a media substrate 415. In various embodiments, the pressure applying mechanism 435 can be used in a combination with a heat lamp to provide both the pressure and heat for the fusing process of the toner particles on the media substrate 415. In addition, the configurations 400A-B can include a mechanical system 445 to move the fuser belt 200 and thus fusing the toner particles and forming images on the media substrate 415. The mechanical system 445 can include one or more rollers 445*a-c*, which can also be used as heat rollers when needed.

Figure 5:
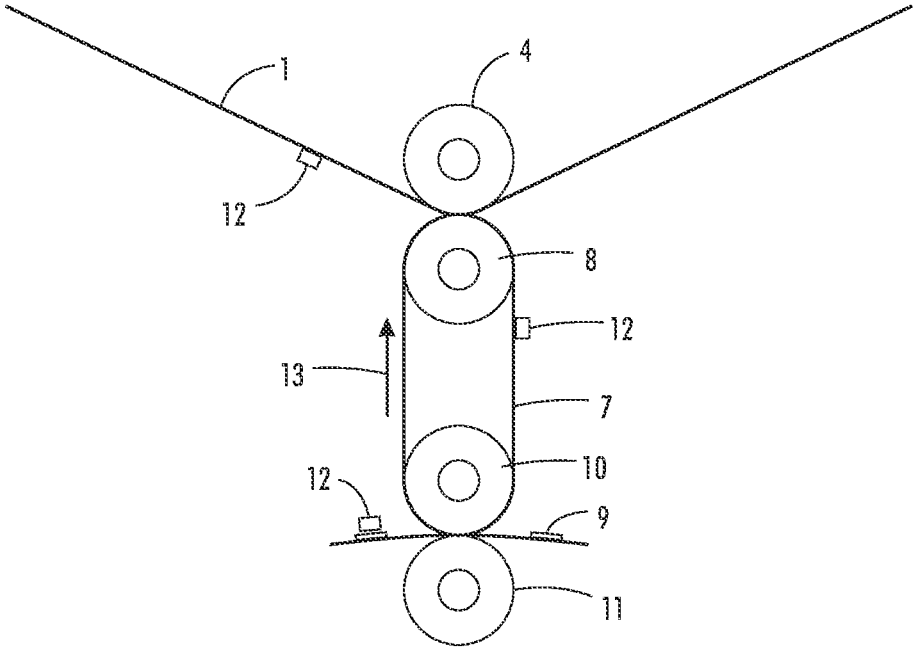
FIG. 5 depicts an exemplary fuser configuration using a transfix apparatus.

FIG. 5 demonstrates a view of an embodiment of a transfix member 7 which may be in the form of a belt, sheet, film, or like form. The transfix member 7 is constructed similarly to the fuser belt 200 described above. The developed image 12 positioned on intermediate transfer member 1 is brought into contact with and transferred to transfix member 7 via rollers 4 and 8. Roller 4 and/or roller 8 may or may not have heat associated therewith. Transfix member 7 proceeds in the direction of arrow 13. The developed image is transferred and fused to a copy substrate 9 as copy substrate 9 is advanced between rollers 10 and 11. Rollers 10 and/or 11 may or may not have heat associated therewith.

The surface layer includes a polyimide aerogel (also referred to as polyimide foam). The polyimide aerogel layer is coated on substrate (if there is no intermediate layer) or on the intermediate layer. The polyimide aerogel provides support for the fluoropolymer that is dispersed throughout the pores of the aerogel. As a result, fuser members having a surface layer polyimide aerogel having a fluoropolymer dispersed throughout the aerogel minimize paper damage, provide improved fusing efficiency, provide a wide media latitude, improve image quality, and enhance energy efficiency.

The polyimide aerogel or polyimide foam for use as a surface layer in a fuser member provides heat-resistance and insulation. The polyimide aerogel has a density of from about 0.1 $gm/cm^3$ to about 0.5 $gm/cm^3$, or from about 0.15 $gm/cm^3$ to about 0.45 $gm/cm^3$, or from about 0.2 $gm/cm^3$ to about 0.4 $gm/cm^3$. The polyimide aerogel has a surface area of from about 100 $m^3/g$ to about 550 $m^3/g$, or from about 150 $m^3/g$ to about 450 $m^3/g$ or from about 200 $m^3/g$ to about 400 $m^3/g$. The polyimide aerogel has a pore diameter of from about 2 nm to about 200 nm, or from 5 nm to about 180 nm or 10 nm to about 150 nm.

The polyimide aerogel layer is prepared by coating a composition that forms a gel. The solvent is extracted from the polyimide gel. After extraction of the solvent, a polyimide aerogel layer remains which is suitable for supporting a fluoropolymer, the fluoropolymer being dispersed throughout the pores of the aerogel.

Polyimide gels are made by coating a composition of one or more anhydride capped polyamic acid oligomers and one or more multi-amines (diamines or triamines) in a solvent to form a gel. The multi-amines crosslink the polyamic acid oligomers through an imidization reaction to form a polyimide gel layer. After the imidization reaction is completed, the solvent is removed through solvent extraction providing a polyimide aerogel layer. Solvent extraction can be accomplished through supercritical $CO_2$. The cast polyimide aerogel films have excellent flexibility, high tensile strengths (i.e. 4-9 MPa), and high onset decomposition temperatures (i.e., 460° C.-610° C.).

The disclosed anhydride capped polyamic acid oligomers include one of a polyamic acid of pyromellitic dianhydride, a polyamic acid of pyromellitic dianhydride, a polyamic acid of biphenyl tetracarboxylic dianhydride, a polyamic acid of biphenyl tetracarboxylic dianhydride, a polyamic acid of benzophenone tetracarboxylic dianhydride, a polyamic acid of benzophenone tetracarboxylic dianhydride, and the like and mixtures thereof.

In embodiments, the anhydride capped polyamic acid oligomers are formed from the reaction of a dianhydride and a diamine. Suitable dianhydrides include aromatic dianhydrides and aromatic tetracarboxylic acid dianhydrides such as, for example, 9,9-bis(trifluoromethyl)xanthene-2,3,6,7-tetracarboxylic acid dianhydride, 2,2-bis(3,4-dicarboxyphenyl)hexafluoropropane dianhydride, 2,2-bis((3,4-dicarboxyphenoxy)phenyl)hexafluoropropane dianhydride, 4,4'-bis(3,4-dicarboxy-2,5,6-trifluorophenoxy)octafluorobiphenyl dianhydride, 3,3',4,4'-tetracarboxybiphenyl dianhydride, 3,3',4,4'-tetracarboxybenzophenone dianhydride, di-(4-(3,4-dicarboxyphenoxy)phenyl)ether dianhydride, di-(4-(3,4-dicarboxyphenoxy)phenyl)sulfide dianhydride, di-(3,4-dicarboxyphenyl)methane dianhydride, di-(3,4-dicarboxyphenyl) ether dianhydride, 1,2,4,5-tetracarboxybenzene dianhydride, 1,2,4-tricarboxybenzene dianhydride, butanetetracarboxylic dianhydride, cyclopentanetetracarboxylic dianhydride, pyromellitic dianhydride, 1,2,3,4-benzenetetracarboxylic dianhydride, 2,3,6,7-naphthalenetetracarboxylic dianhydride, 1,4,5,8-naphthalenetetracarboxylic dianhydride, 1,2,5,6-naphthalenetetracarboxylic dianhydride, 3,4,9,10-perylenetetracarboxylic dianhydride, 2,3,6,7-anthracene tetracarboxylic dianhydride, 1,2,7,8-phenanthrenetetracarboxylic dianhydride, 3,3',4,4'-biphenyltetracarboxylic dianhydride, 2,2',3,3'-biphenyltetracarboxylic dianhydride, 3,3',4-4'-benzophenonetetracarboxylic dianhydride, 2,2',3,3'-benzophenonetetracarboxylic dianhydride, 2,2-bis(3,4-dicarboxyphenyl)propane dianhydride, 2,2-bis(2,3-dicarboxyphenyl)propane dianhydride, bis(3,4-dicarboxyphenyl)ether dianhydride, bis(2,3-dicarboxyphenyl)ether dianhydride, bis(3,4-dicarboxyphenyl)sulfone dianhydride, bis(2,3-dicarboxyphenyl)sulfone 2,2-bis(3,4-dicarboxyphenyl)-1,1,1,3,3,3-hexafluoropropane dianhydride, 2,2-bis(3,4-dicarboxyphenyl)-1,1,1,3,3,3-hexachloropropane dianhydride, 1,1-bis(2,3-dicarboxyphenyl)ethane dianhydride, 1,1-bis(3,4-dicarboxyphenyl)ethane dianhydride, bis (2,3-dicarboxyphenyl)methane dianhydride, bis(3,4-dicarboxyphenyl)methane dianhydride, 4,4'-(p-phenylenedioxy) diphthalic dianhydride, 4,4'-(m-phenylenedioxy)diphthalic dianhydride, 4,4'-diphenylsulfidedioxybis(4-phthalic acid) dianhydride, 4,4'-diphenylsulfonedioxybis(4-phthalic acid) dianhydride, methylenebis(4-phenyleneoxy-4-phthalic acid) dianhydride, ethylidenebis(4-phenyleneoxy-4-phthalic acid) dianhydride, isopropylidenebis-(4-phenyleneoxy-4-phthalic acid)dianhydride, hexafluoroisopropylidenebis(4-phenyleneoxy-4-phthalic acid)dianhydride, and the like.

Exemplary diamines suitable for use in the preparation of the anhydride capped polyamic acid oligomers include 4,4'-bis-(m-aminophenoxy)-biphenyl, 4,4'-bis-(m-aminophenoxy)-diphenyl sulfide, 4,4'-bis-(m-aminophenoxy)-diphenyl sulfone, 4,4'-bis-(p-aminophenoxy)-benzophenone, 4,4'-bis-(p-aminophenoxy)-diphenyl sulfide, 4,4'-bis-(p-aminophenoxy)-diphenyl sulfone, 4,4'-diamino-azobenzene, 4,4'-diaminobiphenyl, 4,4'-diaminodiphenylsulfone, 4,4'-diamino-p-terphenyl, 1,3-bis-(gamma-aminopropyl)-tetramethyl-disiloxane, 1,6-diaminohexane, 4,4'-diaminodiphenylmethane, 3,3'-diaminodiphenylmethane, 1,3-diaminobenzene, 4,4'-diaminodiphenyl ether, 2,4'-diaminodiphenylether, 3,3'-diaminodiphenylether, 3,4'-diaminodiphenylether, 1,4-diaminobenzene, 4,4'-diamino-2,2',3,3',5,5',6,6'-octafluoro-biphenyl, 4,4'-diamino-2,2',3,3',5,5',6,6'-octafluorodiphenyl ether, bis[4-(3-aminophenoxy)-phenyl]sulfide, bis[4-(3-aminophenoxy)phenyl]sulfone, bis [4-(3-aminophenoxy)phenyl]ketone, 4,4'-bis(3-aminophenoxy)biphenyl, 2,2-bis[4-(3-aminophenoxy) phenyl]-propane, 2,2-bis[4-(3-aminophenoxy)phenyl]-1,1,1,3,3,3-hexafluoropropane, 4,4'-diaminodiphenyl sulfide, 4,4'-diaminodiphenyl ether, 4,4'-diaminodiphenyl sulfone, 4,4'-diaminodiphenylmethane, 1,1-di(p-aminophenyl)ethane, 2,2-di(p-aminophenyl)propane, and 2,2-di(p-aminophenyl)-1,1,1,3,3,3-hexafluoropropane, and the like and mixtures thereof.

Exemplary multi-amines suitable for crosslinking of anhydride capped polyamic acid oligomers include diamines and triamines. The diamines listed above can be use to cross-link the dianhydride capped poly(amic) acid oligomers. Example of additional multi-amine compounds include 1,3,5-triaminophenoxybenzene, 1,3,5-triaminobenzene, cyclohexane-1,3,5-triamine, 1,3,5-triazine-2,4,6-triamine, 1,3,5-triazine-2,4,6-triamine, N2-(4,6-diamino-1,3,5-triazin-2-yl)-1,3,5-triazine-2,4,6-triamine, N2-(4,6-diamino-1,3,5-triazin-2-yl)-1,3,5-triazine-2,4,6-triamine, N2-(4,6-diamino-1,3,5-triazin-2-yl)-1,3,5-triazine-2,4,6-triamine, N2-(4,6-diamino-1,3,5-triazin-2-yl)-1,3,5-triazine-2,4,6-triamine, N2-(4,6-diamino-1,3,5-triazin-2-yl)-octa(aminophenyl) silsesquioxane.

The anhydride capped polyamic acid oligomers and multi-amines are, for example, selected in a weight ratio of diamine or triamine to polyamic acid oligomers of from about 1 percent to about 5 percent, and more specifically, in an about 2 percent weight ratio. The above anhydrides and diamines and triamines are used singly or as a mixture, respectively. A dianhydride and a diamine are mixed at room temperature in an aprotic organic solvent such as NMP, DMAc, or DMF to form a polyamic acid. The triamine is added into the polyamic acid solution, and then acetic anhydride and pyridine are added for chemical imidization. Gels are formed in about 20 min after addition of acetic anhydride and pyridine. After aging for 12 hours, the gel is extracted with a series of solutions including a solution of 75 weight percent NMP in acetone, 25 weight percent NMP in acetone, and 100 percent acetone. The solvent is removed by supercritical $CO_2$ extraction at 31° C./1100-1400 psi, followed by drying under vacuum at 80° C.

The polyamic acid oligomers and amine composition includes a solvent. Examples of the solvent selected to form the composition include toluene, hexane, cycloheaxne, heptane, tetrahydrofuran, methyl ethyl ketone, methyl isobutyl ketone, N,N'-dimethylformamide, N,N'-dimethylacetamide, N-methylpyrrolidone (NMP), methylene chloride and the like and mixtures thereof where the solvent is selected, for example, in an amount of from about 70 weight percent to about 95 weight percent, and from 80 weight percent to about 90 weight percent based on the amounts in the coating mixture.

After formation of the polyimide gel layer, it is necessary to remove the solvent from the gel. This is accomplished by exchanging the solvent with supercritical $CO_2$, and vacuum drying to remove the $CO_2$ to leave the pores in the gel intact. In embodiments, the solvent of the coating solution can be exchanged with a second solvent such as acetone which is soluble in supercritical $CO_2$, which improves solvent removal. The conditions for removing the $CO_2$ include a temperature of about 31° C. and a pressure of from about 1100 psi to about 1400 psi.

After the polyimide aerogel is provided on the fuser member, a fluoropolymer is provided that is dispersed throughout the polyimide aerogel. The polyimide aerogel coating is prepared by applying a NMP solution of oligomeric polyimide onto a substrate by dip-coating or flow-coating. After the gel layer is formed and aged for 24 hours, it is extracted with a solution of 75% NMP in acetone and soaked overnight. Subsequently, the solvent is exchanged in 24 h intervals with 25% NMP in acetone, and finally 100% acetone. Vacuum drying overnight at 80° C., optionally supercritical $CO_2$ extraction before drying results in a polyimide aerogel layer with nanoporosity (~90% porosity, FIG. 1).

The fuser surface layer or release layer includes the polyimide aerogel having dispersed throughout a cross-linked fluoropolymer and a release agent which is a liquid at a temperature of greater than 100° C.

The cross-linked fluoropolymer includes; copolymers of two of vinylidenefluoride, hexafluoropropylene, and tetrafluoroethylene; terpolymers of vinylidenefluoride, hexafluoropropylene, and tetrafluoroethylene; tetrapolymers of vinylidenefluoride, hexafluoropropylene, tetrafluoroethylene and a cure site monomer; perfluoropolyether and siloxyfluorocarbon. The release agent includes perfluoropolyether; polysiloxanes, for examples silicone oil; fluorinated polysiloxanes; fluorinated silanes; and polyhedral oligomeric silsesquioxanes (POSS). The amount of cross-linked fluoropolymer in the release layer containing the polyimide aerogel ranges from about 10 weight percent to about 95 weight percent, or in embodiments from about 20 weight percent to about 90 weight percent or from about 50 weight percent to about 80 weight percent. The amount of the release agent which is a liquid at a temperature of greater than 100° C. in the release layer containing the polyimide aerogel ranges from about 1 weight percent to about 50 weight percent, or from about 5 weight percent to about 40 weight percent or from about 10 weight percent to about 20 weight percent. The thickness of the release layer ranges from about 5 μm to about 400 μm, or from about 20 μm to about 300 μm, or from about 25 μm to about 200 μm.

Cross-Linked Fluoropolymers

Suitable cross-linked fluoropolymers include the fluoroelastomers listed previously for the intermediate layer. Fluoroplastics are suitable for use herein and include a monomeric repeat unit that is selected from the group consisting of vinylidene fluoride, hexafluoropropylene, tetrafluoroethylene, perfluoroalkylvinylether, and mixtures thereof. Examples of fluoroplastics include polytetrafluoroethylene (PTFE); perfluoroalkoxy polymer resin (PFA); copolymer of tetrafluoroethylene (TFE) and hexafluoropropylene (HFP); copolymers of hexafluoropropylene (HFP) and vinylidene fluoride (VDF or VF2); terpolymers of tetrafluoroethylene (TFE), vinylidene fluoride (VDF), and hexafluoropropylene (HFP); and tetrapolymers of tetrafluoroethylene (TFE), vinylidene fluoride (VF2), and hexafluoropropylene (HFP), and mixtures thereof.

Suitable cross-linked fluoropolymers also include cross-linked perfluoropolyether is available from Shin-Etsu (Tradename SIFEL®).

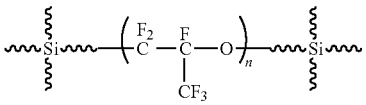

where n is a number of from about 0 to about 5000.

A siloxyfluorocarbon network (SFC) is a suitable fluoropolymer that can be incorporated within the polyimide aerogel. A SFC network includes alkoxysilane precursors. The mole ratios of the alkoxysilane precursors can be varied resulting in a highly tunable system. The alkoxysilane precursors can be incorporated into a liquid coating formulation which can be spray or flow coated from non-fluorinated solvents directly onto polymer fiber matrix and cured at temperatures at or below 180° C.

The siloxyfluorcarbon networked polymer is formed via sol-gel chemistry. Siloxyfluorocarbon monomers are crosslinked via sol-gel chemistry, where hydrolysis and condensation of alkoxide or hydroxide groups occurs and upon curing at elevated temperatures, produces a coating used on fusing surfaces. The siloxyfluorocarbon networked polymer can withstand high temperature conditions without melting or degradation, is mechanically robust under fusing conditions, and displays good release under fusing conditions.

Monofunctional, difunctional, or trifunctional silane end groups may be used to prepare a siloxyfluorocarbon networked polymer. Siloxyfluorocarbon monomers are represented by the structure:

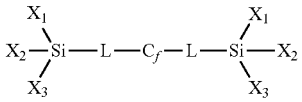

wherein $C_f$ is a linear aliphatic or aromatic fluorocarbon chain having from 2 to 40 carbon atoms; L is a $C_nH_{2n}$ group, where n is a number between 0 and about 10; and $X_1$, $X_2$, and $X_3$ are reactive hydroxide functionalities, reactive alkoxide functionalities, unreactive aliphatic functionalities of from about 1 carbon atom to about 10 carbon atoms, unreactive aromatic functionalities of from about 1 carbon atom to 10 carbon atoms wherein all siloxyfluorocarbon monomers are bonded together via silicon oxide (Si—O—Si) linkages in a single system and wherein the siloxyfluorocarbon networked polymer is insoluble in solvents selected from the group consisting of ketones, chlorinated solvents and ethers.

In addition to the monomers listed above, the siloxyfluorocarbon networked polymer can be prepared using monomers having the following structure:

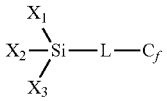

wherein $C_f$ represents a linear or branched aliphatic or aromatic fluorocarbon chain having from about 2 to 40 carbon atoms; L is a $C_1H_{2n}$ group, where n is a number between 0 and about 10, wherein m is between 1 and 3; and $X_1$, $X_2$, and $X_3$ are reactive hydroxide functionalities, reactive alkoxide functionalities, unreactive aliphatic functionalities of from about 1 carbon atom to about 10 carbon atoms or unreactive aromatic functionalities of from about 1 carbon atom to 10 carbon atoms and wherein all siloxyfluorocarbon monomers are bonded together via silicon oxide (Si—O—Si) linkages in a single system and wherein the siloxyfluorocarbon networked polymer is insoluble in solvents selected from the group consisting of ketones, chlorinated solvents and ethers.

In addition to the monomers listed above, the siloxyfluorocarbon networked polymer can be prepared using monomers that include non-fluorinated silane monomers selected from the group consisting of silicon tetraalkoxide and branched pentasilanes. The silicon tetraalkoxide is represented;

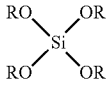

where R may be hydrogen, methyl, ethyl, propyl, isobutyl, other hydrocarbon groups, or mixtures thereof.

The branched pentasilanes may be generally represented by the respective structure:

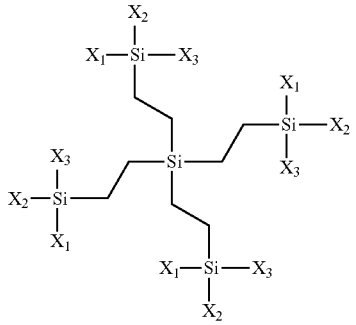

where $X_1$, $X_2$, and $X_3$ are as defined above.

The siloxyfluorocarbon networked polymer comprises a fluorine content of between about 20 weight percent to about 70 weight percent or from about 25 weight percent to about 70 weight percent or from about 30 weight percent to about 60 weight percent. The silicon content, by weight, in the siloxyfluorocarbon networked polymer is from about 1 weight percent silicon to about 20 weight percent silicon, or from about 1.5 weight percent silicon to about 15 weight percent silicon or from about 2 weight percent silicon to about 10 weight percent silicon.

The monomers are networked together so that all monomers are molecularly bonded together in the cured coating via silicon oxide (Si—O—Si) linkages. Therefore, a molecular weight can not be given for the siloxyfluorocarbon networked polymer because the coating is crosslinked into one system.

Solvents used for sol gel processing of siloxyfluorocarbon precursors and coating of layers include organic hydrocarbon solvents, and fluorinated solvents. Exemplary coating solvents include alcohols such as methanol, ethanol, isopropanol, and n-butanol are typically used to promote sol gel reactions in solution. Further examples of solvents include ketones such as methyl ethyl ketone, and methyl isobutyl ketone. Mixtures of solvents may be used. The solvent system included the addition of a small portion of water, such as from about 1 molar equivalent to 10 molar equivalents of water compared to the total molar equivalents of silicon, or from about 2 molar equivalents to about 4 molar equivalents of water.

Upon the addition of water to the solution of sol gel precursors, alkoxy groups react with water, and condense to form agglomerates that are partially networked, and are referred to as a sol. Upon coating of the partially networked sol onto the polyimide aerogel, a gel is formed upon drying, and with subsequent heat treatment, the fully networked SFC coating (siloxyfluorocarbon networked polymer) is formed within the polyimide aerogel.

A siloxyfluorocarbon networked polymer does not dissolve when exposed to solvents (such as ketones, chlorinated solvents, ethers etc.) and does not degrade at temperatures up to 250° C., and is stable at higher temperatures, depending on the system. The siloxyfluorocarbon networked polymer exhibits good release when exposed to toner or other contaminants, so that toner and other printing-related materials do not adhere to the fusing member.

The cross-linked SFC polymer does not have a melting point or a glass transition temperature (Tg). The surface repair is dependent on the rate at which POSS can diffuse through the matrix to the surface. It is more dependent on cross-link density which is dependent on SFC formulation.

In an embodiment, one can use metal alkoxide (M=Si, Al, Ti etc.) functionalities as cross-linking components between fluorocarbon chains. For cross-linking to occur efficiently throughout the composite, bifunctional fluorocarbon chains are used. Mono-functional fluorocarbon chains can also be added to enrich fluorination content. $CF_3$-terminated chains align at the fusing surface to reduce surface energy and improve release.

Examples of precursors that may be used to form a composite system include silicon tetraalkoxide and siloxane-terminated fluorocarbon chains and are shown below. Siloxane-based sol-gel precursors are commercially available. The addition of a silicon tetraalkoxide (such as a silicon tetraalkoxide, below) introduces extra cross-linking and robustness to the material, but is not necessary to form the sol-gel/fluorocarbon composite system.

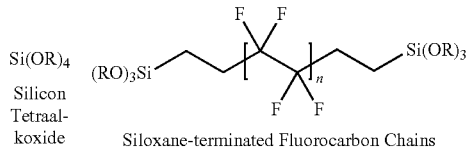

Fluorocarbon chains include readily available dialkene precursors which can then be converted to silanes via hydrosilation (Reaction 1) yielding. Monofunctional fluorinated siloxane chains are commercially available as methyl or ethyl siloxanes, or could be converted from chlorosilane or dialkene precursors.

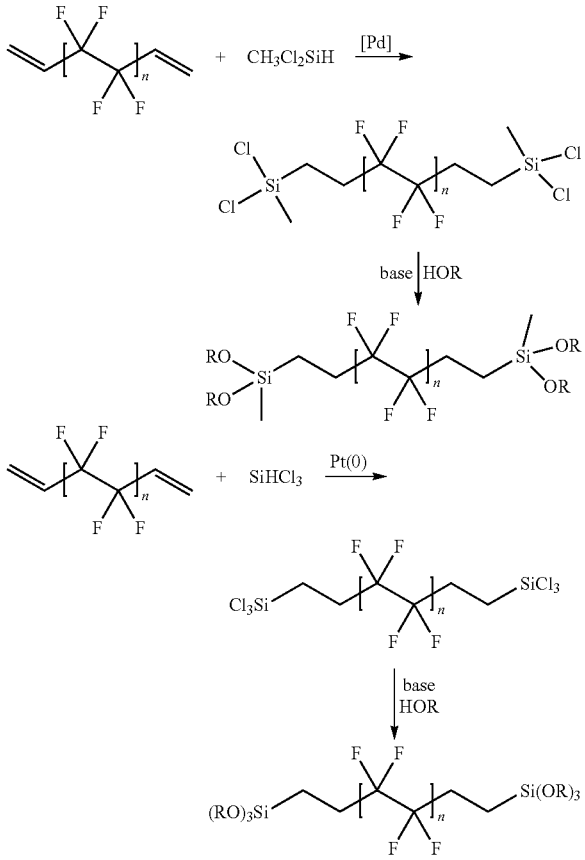

Reaction 1: Preparation of Fluorinated Alkoxysilane Precursors.

The alkoxysilane precursors can be varied resulting in a highly tunable system and are typically spray or flow coated from non-fluorinated solvents directly onto polymer fiber matrix and cured at temperatures at or below 180° C. The formation of the networked SFC within and on top of the polymer fiber matrix is shown below.

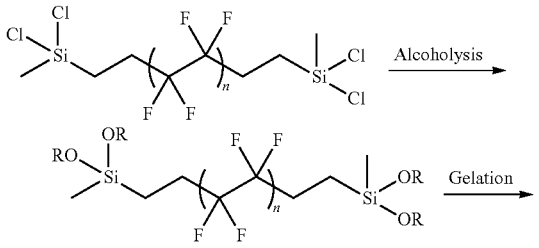

SFC Precuror

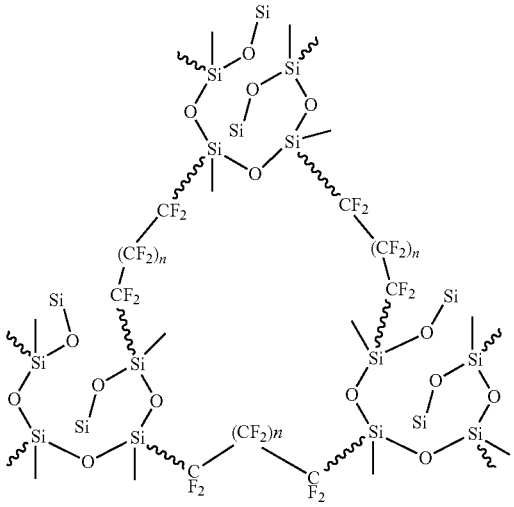

SFC Network

Release Agents

The release agent which is a liquid at a temperature of greater than 100° C. includes perfluoropolyether; polysiloxanes, for examples silicone oil; fluorinated polysiloxanes; fluorinated silanes; and polyhedral oligomeric silsesquioxanes (POSS).

Polyhedral oligomeric silsesquioxanes (POSS) with perfluoroalkyl substituents are suitable release agents and chemically similar to the cross-lined polymers described previously enabling dissolution and dispersion of the POSS within the cross-linked polymer.

Polysiloxanes, for examples silicone oil; fluorinated polysiloxanes; fluorinated silanes are well known release agents used in electrophotographic apparatuses.

Suitable perfluorpolyether for use as a release agent in described in U.S. Pat. No. 7,491,435, incorporated in its entirety herein. Examples of suitable release agents include those having the following skeletal Formulas I or II:

$$CF_3—(CF_2CF_2)_m—O—(R_1R_2O)—(R_3R_3O)_p—(R_3O)_p—(CF_2)_q—CF_3 \quad \text{(Formula I)}$$

wherein $R_1$ is $CF_2$, CF—$CF_3$ or —$NHR_4$; $R_2$ is $CF_2$, CF—$CF_3$, or —$NR_4R_5$; and $R_3$ is $CF_2$ or $CF_3$, $R_4$ is selected from the group consisting of hydrogen, alkyl group having from about 1 to about 18 carbon atoms or from about 1 to about 8 carbons or from about 1 to about 6 carbons or from about 1 to about 3 carbon atoms, arylalkyl group (with either the alkyl group or the aryl group being attached to the silicon atom) having from about 7 to about 18 carbon atoms or from about 7 to about 9 carbon atoms, mercapto, hydride or carbinol functional group; $R_5$ is selected from the group consisting of alkyl having from about 1 to about 20 carbons or from about 1 to about 10 carbons such as methyl, ethyl, butyl and the like, and a fluoroalkyl having from about 2 to about 10 carbons such as fluoromethyl, fluorobutyl, difluoroethyl, and the like; m is a number of 0 or 1; n is a number of from about 0 to about 500, or from about 200 to about 350; p is a number of from about 0 to about 100 or from about 50 to about 75; q is a number of 0 or 1; and p+n is a number of from about 100 to about 500 or from about 250 to about 425; and $$CF_3—(CF_2CF_2)_m—O—(R_2R_2O)_n—(R_2O)_p—(CF_2)_q—CF_2—R_1 \quad \text{(Formula II)}$$

wherein; $R_2$ is selected from the group consisting of $CF_2$ and CF—$CF_3$; m is a number of 0 or 1; n is a number of from about 0 to about 500, or from about 200 to about 350; p is a number of from about 0 to about 100 or from about 50 to about 75; q is a number of 0 or 1; and p+n is a number of from about 100 to about 500 or from about 250 to about 425. The alkyl groups above can include including linear, branched, cyclic, and unsaturated alkyl groups.

Additional perfluoropolyethers available from Shin Etsu include

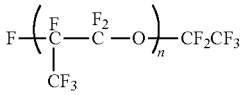

where n is a number of from about 0 to about 500.

In embodiments, the perfluoropolyether release agent has a viscosity of from about 75 to about 1,500 cS, or from about 100 to about 1,000 cS, when the release agent is used with toner.

Polyhedral oligomeric silsesquioxanes (POSS) with longer perfluoroalkyl substituents are suitable release agents. They are the most hydrophobic crystalline solid materials known and incorporation into the fluoropolymer-polyimide aerogel release layer lowers the surface free energy (SFE) and improves toner release. Furthermore, the low melting point of these perfluorinated POSS materials (less than 100° C.0 means the POSS will be in the melt phase during fusing which can result in 'sustained release' of toner as POSS migrates and replenishes and repairs the surface layer of the fuser.

The fluorinated polyhedral oligomeric silsesquioxane is represented by:

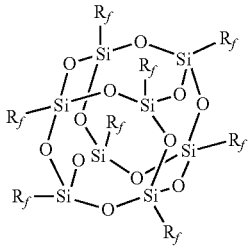

wherein $R_f$ is a linear aliphatic or aromatic fluorocarbon chain having from 2 to 40 carbon atoms. In embodiments Rf is $CH_2CH_2CF_2CF_2CF_2CF_3$ (fluorohexyl) or $CH_2CH_2CF_2CF_2CF_2CF_2CF_2CF_3$ (fluorooctyl) or $CH_2CH_2CF_2CF_2CF_2CF_2CF_2CF_2CF_2CF_3$ (fluorodecyl).

Alternatively, a blend of functional silicone materials and nonfunctional perfluorinated polyether release agent and POSS can be used to combine the advantages of both individual release agents.

Specific embodiments will now be described in detail. These examples are intended to be illustrative, and not limited to the materials, conditions, or process parameters set forth in these embodiments. All parts are percentages by solid weight unless otherwise indicated.

EXAMPLES

Preparation of polyimide aerogel coating was conducted. A solution of biphenyl-3,3',4,4'-tetracarboxylic dianhydride (BPDA) (2.395 g, 8.15 mmol) and 4,4'-oxydianiline (ODA) (1.58 g, 7.9 mmol) in 25 mL of n-methylppyrrolidine (NMP) was stirred at room temperature under argon gas for 30 min. To the solution, a solution of 1,3,5,-triaminophenoxybenzene (TAB) (0.175 mmol, 0.07 g) in 8 mL of NMP was added. This solution was stirred for 1 hour, and then acetic anhydride (65 mmol, 6.15 g) and pyridine (65 mmol, 5.14 g) were added the solution. The solution was coated onto a polyimide belt substrate and a gel layer was formed within 20 minutes. The gel layer was aged for 24 hours. Following aging, the gel was extracted with a solution of 75% NMP in acetone and soaked overnight. The solvent in the gel was exchanged in 24 hour intervals with 25% NMP in acetone, and then 100% acetone. Finally, supercritical $CO_2$ extraction at about 1100 psi at 31° C. and drying under vacuum results in a polyimide aerogel layer having a porosity of about 90 percent. The polyimide aerogel layer has excellent flexibility, high tensile strengths (i.e. 4-9 MPa), and high onset decomposition temperatures (i.e., 460° C.-610° C.).

After the polyimide aerogel is applied to a fuser roller coated having a silicone layer, a composition of cross-linked perfluorpolyether (SIFEL®) mixed with liquid perfluoropolyether is flow-coating onto the polyimide aerogel layer. The mixture of cross-linked perfluorpolyether and liquid perfluorpolyether is cured through heat-treatment at about 150° C. to about 200° C. The cured polyfluoropolyether is dispersed throughout the polyimide aerogel layer.

It will be appreciated that variants of the above-disclosed and other features and functions or alternatives thereof may be combined into other different systems or applications. Various presently unforeseen or unanticipated alternatives, modifications, variations, or improvements therein may be subsequently made by those skilled in the art, which are also encompassed by the following claims.

What is claimed is:

1. A fuser member comprising:

a substrate;

a surface layer disposed on the substrate, the surface layer comprising a polyimide aerogel layer having dispersed throughout a cross-linked fluoropolymer and a release agent wherein the release agent is a liquid at a temperature above about 100° C.

2. The fuser member of claim 1, wherein the polyimide aerogel layer comprises a porosity of from about 50 percent to about 95 percent.

3. The fuser member of claim 1, wherein the cross-linked fluoropolymer is selected from the group consisting of: copolymers of two of vinylidenefluoride, hexafluoropropylene, and tetrafluoroethylene; terpolymers of vinylidenefluoride, hexafluoropropylene, and tetrafluoroethylene; tetrapolymers of vinylidenefluoride, hexafluoropropylene, tetrafluoroethylene and a cure site monomer; a perfluoropolyether, and a siloxanefluorocarbon.

4. The fuser member of claim 1, wherein the cross-linked fluoropolymer comprises from about 10 weight percent to about 95 weight percent of the surface layer.

5. The fuser member of claim 1, wherein the release agent is selected from the group consisting of: perfluoropolyethers; polysiloxanes; fluorinated polysiloxanes; fluorinated silanes; and polyhedral oligomeric silsesquioxanes.

6. The fuser member of claim 1, wherein the release agent comprises from about 1 weight percent to about 50 weight percent of the surface layer.

7. The fuser member of claim 1, wherein a surface free energy of the surface layer is less than 25 N/m.

8. The fuser member of claim 1, wherein the surface layer can be repaired when heated to a temperature of greater than 100° C. for a time of about 1 minute.

9. The fuser member of claim 1, further comprising an intermediate layer disposed between the surface layer and the substrate, wherein the intermediate layer comprises an elastomer.

10. The fuser member of claim 1, wherein the surface layer further comprises conductive particles selected from the group consisting of carbon black, graphene, tin oxide, antimony dioxide, antimony-doped tin oxide, titanium dioxide, indium oxide, zinc oxide, indium oxide and indium-doped tin trioxide, polyaniline and polythiophene.

11. The fuser member of claim 1, wherein the surface layer has a thickness of from about 5 microns to about 400 microns.

12. The fuser member of claim 1 wherein the polyimide aerogel has a density of from about 0.1 $gm/cm^3$ to about 0.5 $gm/cm^3$.

13. The fuser member of claim 1 wherein the polyimide aerogel has a surface area of from about 100 $m^2/g$ to about 550 $m^2/g$.

14. The fuser member of claim 1 wherein the polyimide aerogel has a pore diameter of from about 2 nm to about 200 nm.

15. A fuser member comprising:

a substrate;

an intermediate layer disposed on the substrate; and a surface layer disposed on the intermediate layer, the surface layer comprising a polyimide aerogel layer having dispersed throughout a cross-linked fluoropolymer and a release agent, wherein the cross-linked fluoropolymer comprises from about 10 weight percent to about 95 weight percent of the surface layer, wherein the release agent is a liquid at a temperature at 100° C. or greater, wherein the release agent comprises from about 1 weight percent to about 50 weight percent of the surface layer.

16. The fuser member of claim 15, wherein the polyimide aerogel layer has a pore diameter of from about 2 nanometers to about 200 nanometers.

17. A fuser member comprising:

a substrate;

a surface layer disposed on the substrate, the surface layer comprising a polyimide aerogel layer having dispersed throughout a siloxyfluorocarbon (SFC) networked polymer and a fluorinated polyhedral oligomeric silsesquioxane, wherein the polyimide aerogel has a porosity of from about 50 percent to about 95 percent and wherein the polyimide aerogel layer has pores having a pore diameter of from about 2 nanometers to about 200 nanometers, and wherein the surface layer has a thickness of from about 5 microns to about 400 microns.

18. The fuser member of claim 17, wherein the siloxyfluorocarbon monomers further comprise monomers represented by:

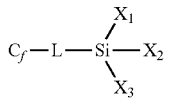

wherein $C_f$ is a linear or branched aliphatic or aromatic fluorocarbon chain having from about 2 to about 40 carbon atoms; L is a $C_nH_{2n}$ group, where n is a number between 0 and about 10, wherein m is between 1 and 3; and $X_1$, $X_2$, and $X_3$ are selected from the group consisting of: reactive hydroxide functionalities, reactive alkoxide functionalities, unreactive aliphatic functionalities of from about 1 carbon atom to about 10 carbon atoms and unreactive aromatic functionalities of from about 1 carbon atom to 10 carbon atoms.

19. The fuser member of claim 17, wherein the fluorinated polyhedral oligomeric silsesquioxane is represented by:

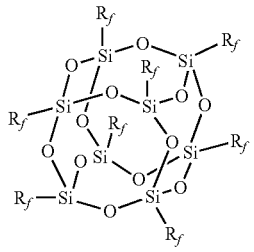

wherein $R_f$ is a linear aliphatic or aromatic fluorocarbon chain having from about 2 to about 40 carbon atoms.

* * * * *